US007887473B2

(12) United States Patent
Nagata et al.

(10) Patent No.: US 7,887,473 B2
(45) Date of Patent: Feb. 15, 2011

(54) PACKAGING BAG

(75) Inventors: Kenji Nagata, Chiyoda-ku (JP); Toru Ichikawa, Chiyoda-ku (JP)

(73) Assignee: Hosokawa Yoko Co., Ltd, Tokyo (JP)

( * ) Notice: Subject to any disclaimer, the term of this patent is extended or adjusted under 35 U.S.C. 154(b) by 0 days.

(21) Appl. No.: 12/544,716

(22) Filed: Aug. 20, 2009

(65) Prior Publication Data

US 2010/0011707 A1 Jan. 21, 2010

Related U.S. Application Data

(62) Division of application No. 11/499,772, filed on Aug. 7, 2006, now abandoned.

(30) Foreign Application Priority Data

Aug. 11, 2005 (JP) ..... 2005-233669

(51) Int. Cl.
*B31B 1/28* (2006.01)

(52) U.S. Cl. ..... 493/218; 493/89; 493/374; 493/210; 493/84

(58) Field of Classification Search ..... 493/52, 493/84, 89, 93, 95, 96, 98, 102, 210, 212–215, 493/217–218
See application file for complete search history.

(56) References Cited

U.S. PATENT DOCUMENTS

| | | | | |
|---|---|---|---|---|
| 2,678,768 | A | | 5/1954 | Vergobbi |
| 2,802,617 | A | | 8/1957 | Roper |
| 2,815,898 | A | | 12/1957 | Thompson |
| 2,930,517 | A | * | 3/1960 | Mensing et al. ..... 229/117.01 |
| 3,430,845 | A | * | 3/1969 | Hoshi et al. ..... 229/87.04 |
| 4,082,216 | A | | 4/1978 | Clarke |
| 4,898,301 | A | | 2/1990 | Schick |
| 5,165,568 | A | | 11/1992 | Wischsen, III |
| 5,762,260 | A | | 6/1998 | Goglio |
| 6,908,422 | B2 | | 6/2005 | Ichikawa et al. |
| 2004/0101216 | A1 | | 5/2004 | Ichikawa |
| 2005/0053315 | A1 | | 3/2005 | Aasen |

FOREIGN PATENT DOCUMENTS

| | | |
|---|---|---|
| EP | 0 785 148 | 7/1997 |
| EP | 1 132 312 | 9/2001 |
| EP | 1 424 290 | 6/2004 |
| JP | 2001-322187 | 11/2001 |

* cited by examiner

*Primary Examiner*—Christopher Harmon
(74) *Attorney, Agent, or Firm*—Young & Thompson

(57) ABSTRACT

A method of manufacturing a packaging bag includes steps of: preparing a sheet of rectangular film material; forming a bag body from the sheet of the rectangular film material; preparing a shaping member; preparing and attaching a fastener; forming a vertical sealing portion; forming the bottom surface portion so as to include a lower end seal portion; a triangular folded portion; and a flat surface folding portion; and forming the lower sealing portion so as to include a central sealing portion; and a side sealing portion.

3 Claims, 7 Drawing Sheets

PACKAGING BAG

This application is a division of co-pending application Ser. No. 11/499,772, filed on Aug. 7, 2006. The content of which is hereby incorporated by reference.

BACKGROUND OF THE INVENTION

1. Field of the Invention

The present invention relates to a packaging bag in which a shaping member for keeping a bag shape to a hexahedron shape is disposed inside a bag body.

2. Related Art

Conventionally, there is known a packaging bag in which a fastener is attached to an inner surface of an opening portion of a bag body for the purpose of re-sealing the opening portion after once opened. In recent years, to such packaging bag, it is desired as an increased demand to accommodate a content in the packaging bag without deforming or damaging the outer appearance thereof. The applicant of the subject patent application has been studying and developing so as to satisfy such desire and provided technology which was disclosed in the Japanese Patent Laid-open (Unexamined) Publication No. 2001-322187.

The invention disclosed in the this patent publication relates to a packaging bag provided with a bag body formed of a film material, and a shaping member is disposed inside the bag body to keep the outer appearance of the bag body in shape of hexahedron. In a case of forming such packaging bag, a sheet of film material is bent at its central portion, and both side edge portions of the bent sheet are then bonded.

Flat surface portions and side surface portions of the packaging bag are formed by applying tensions to the film material forming the bag body by the shaping member disposed therein. On the other hand, an upper portion of the packaging bag is formed by bending, toward the central portion, portions corresponding to the respective flat surface portions in a portion protruding over an upper end portion of the shaping member, folding back, toward a bottom surface side, triangular portions corresponding to the respective side surface portions and sealing the folded portions to the side surface portions. The bottom surface portion of the packaging bag is formed by bending the triangular protruded portions formed on both sides of the bottom surface portion toward the central side of the packaging bag and then sealing the bent portion to the outer side surface of the bottom surface portion.

The packaging bag disclosed in the above publication has a subject feature of capable of accommodating a content in the bag body without deforming the shape of the content by keeping the outer shape or appearance of the bag body to the hexahedron shape by using the shaping member.

The applicant has been studied and developed such packaging bag after the disclosure of such invention as in the above publication so as to improve productivity, to improve inner-content protective performance, to reduce possibility of the deformation of the shape, to reduce possibility of breakage of packaging bag and so on.

SUMMARY OF THE INVENTION

The present invention was conceived in consideration of the above circumstances and an object of the present invention is to provide a packaging bag having an improved strength and rigidity, so that inner content can be safely protected from deforming or damaging the shape of the packaging bag.

This and other object can be achieved according to the present invention by providing packaging bag comprising:

a bag body formed from a sheet of rectangular film material;

a shaping member for keeping the shape of the bag body so as to provide a hexahedron shape having a pair of opposing flat surface portions, a pair of side surface portions positioned on the both sides of the flat surface portions, an upper surface portion and a bottom surface portion opposing to the upper surface portion; and a fastener attached to the upper surface portion to be re-sealable after being once opened, the shaping member having flat surface forming portions corresponding to the flat surface portions of the bag body and side surface forming portions corresponding to the side surface portions of the bag body which are positioned alternately adjacently the flat surface forming portions and the side surface forming portions being folded along folding lines disposed in parallel with each other, and both ends forming end edges of the flat surface forming portions of the shaping member and end edges of the side surface forming portions being abutted against each other, wherein the bag body is formed such that the shaping member is disposed inside, inner surfaces of both the side edges of the film material are bonded with a constant bonding width portion while the shaping member being folded along the folding lines so as to form a tubular member with an upper extending portion extending over the upper end of the shaping member and a lower extending portion extending over the lower end thereof, the flat surface portions and the side surface portions are formed by arranging the film material along the flat surface forming portions and the side surface forming portions of the shaping member, the upper extending portion of the tubular body is folded to form the upper surface portion and the lower extending portion of the tubular body is folded to form the bottom surface portion, a vertical sealing portion formed by bonding side edges of the film material together, at the time of forming the tubular body, so as to extend vertically on one side of the flat surface portion of the packaging bag, the bottom surface portion includes: a lower end seal portion formed by sealing a portion of the lower extending portion having a constant width from the lower end thereof; a triangular folded portion surrounded by a reference line and oblique lines, in which a portion of the lower extending portion extending downward from the side surface portion is folded toward a center side of the packaging bag with the reference line corresponding to the lower end of the shaping member, and a reference point corresponding to the lower edge of the lower sewing portion at the central portion in the longitudinal direction of the packaging bag and an apex point corresponding to the lower end of the shaping member at the longitudinal end edges of the extending portion from the side surface portion are connected and folded so as to provide inward a protrude portion; and a flat surface folding portion, in which at the lower extending portion, the lower end of the shaping member extending from the flat surface portion is folded centrally of the packaging bag as a reference line so as to accord with the triangular folded portion, and the lower sealing portion includes: a central sealing portion formed by sealing the inner surfaces of portions corresponding to the reference points at the extending portion from the flat surface portion; and a side sealing portion formed by sealing the inner surfaces of portions extending from the side surfaces, the side sealing portion being sealed with respectively opposing portions in the longitudinal direction.

In such the packaging bag, it may be further desired that the upper surface portion includes: a flat surface folding portion formed by folding the portion of the upper extending portion extending upward from the flat surface portion centrally with the upper end of the shaping member being the reference line; a triangular extending portion formed by folding so that the extending portions extending upward from the side surface portions so as to laterally protrude in form of triangle with the upper end of the shaping member being the reference line; an overlap portion by overlapping the inner surfaces mutually opposing at the time of folding the upper extending portion at the central portion in the longitudinal direction of the packaging bag above the flat surface folding portion and the triangular extending portion; and an upper seal portion sealing the upper end edge of the overlap portion, wherein the overlap portion is folded back on the back surface side of the packaging bag, and the triangular extending portion is formed to be flat by being folded back so as to be overlapped with the outer surfaces of the corresponding side surfaces.

It is also desirable that vertical sealing portion is disposed on the back surface side of the packaging bag so as to be along one side end edge of the back side surface.

The shaping member may be preferably formed with a bottom surface forming portion extending from the lower ends of the flat surface portions and being foldable with respect to the flat surface forming portions of the shaping member.

According to the present invention of the characters mentioned above, at the bottom surface portion of the packaging bag, an overlapped portion formed by folding the film material occupies much area, so that the strength of the bottom surface portion of the packaging bag can be increased, effectively preventing the breaking of the bottom surface portion even if some force is applied to this bottom surface portion, and hence, the outer appearance of the packaging bag can be maintained without being deformed and the inner content can be protected safely.

The nature and further characteristic features of the present invention will be made more clear from the following descriptions made with reference to the accompanying drawings.

DESCRIPTION OF THE PREFERRED EMBODIMENT

A preferred embodiment of the packaging bag according to the present invention will be described hereunder with reference to the accompanying drawings. Further, it is to be noted that terms "upper", "lower" and like terms are used herein with reference to the illustrations of the drawings or in a generally usable attitude of the packaging bag.

Figure 1:
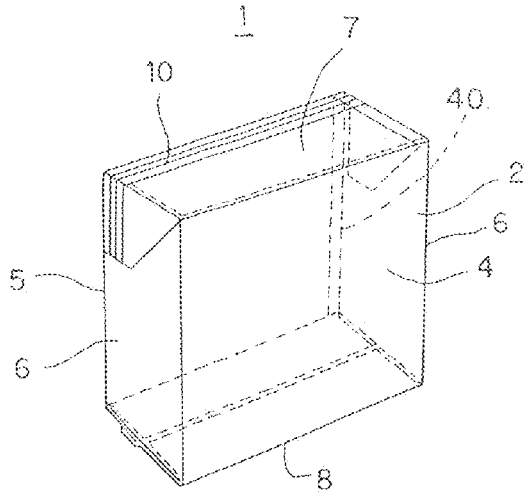
FIG. 1 is a perspective view of a packaging bag according to one embodiment of the present invention.
Figure 2:
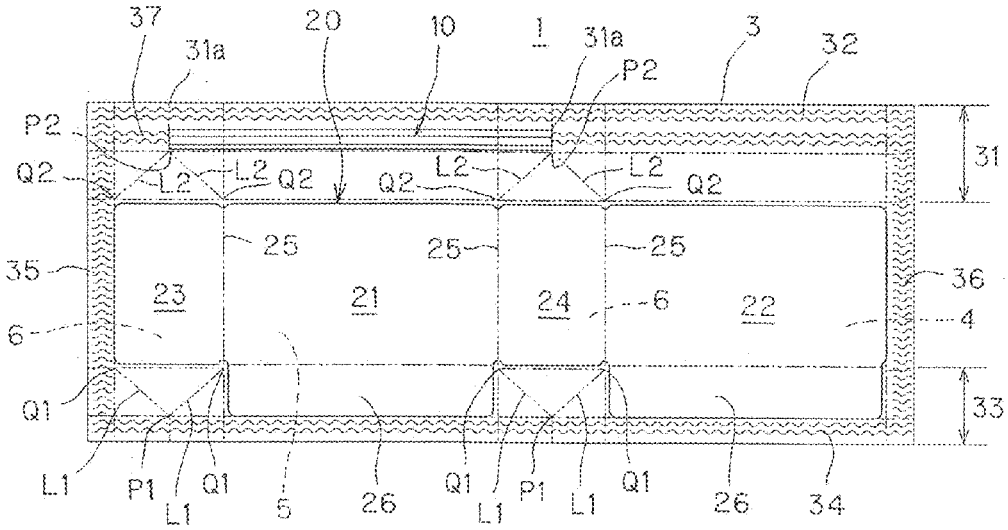
FIG. 2 is a developed view of the packaging bag before manufacture of the packaging bag of FIG. 1.

With reference to FIGS. 1 and 2, the packaging bag 1 is composed of a bag body 2 and a shaping member (shape keeping member) 20 which is disposed inside the bag body 2 and configured to keep the outer shape of the bag body 2 to have a hexahedron shape. The location of the shaping member 20 inside the bag body 2 contributes to maintain the outer shape of the bag body 2 to be a hexahedron shape, so that the packaging bag 1 has a pair of flat surface portions 4 and 5 in the longitudinal direction thereof, a pair of side surface portions 6, 6 and a pair of vertical upper and bottom surface portions 7 and 8. Furthermore, a fastener or fastener member 10 is attached to the upper surface 7 so as to be re-closed or re-sealed after the packaging bag 1 is once opened.

The opposed paired flat surface portions 4 and 5 are pulled in four directions by the shaping member 20 disposed inside the bag body 2 so as to each provide a rectangular shape. Likely, the opposed paired side surface portions 6, 6 are also pulled in four-directions by the shaping member 20 so as to each provide a rectangular shape. Further, one of the flat surface portions is constituted as back surface portion 5, which is formed with a vertical seal line portion 40 at which inner surfaces of overlap sealing width portions are sealed together. This vertical seal line portion 40 extends vertically of the packaging bag 1 along a boundary line between the back surface portion 5 and the side surface portion 6. On the other hand, the upper surface portion 7 and the bottom surface portion 8 are formed by folding the film materials 3, which constitutes the bag body 2, in predetermined processes.

The structure of the packaging bag 1 mentioned above will be more easily and clearly understood through an explanation of manufacturing processes of the packaging bag 1. Hereunder, the structure of the packaging bag 1 will be more clearly described in conjunction with the manufacturing process thereof.

As shown in FIG. 2, the bag body 2 is formed from the rectangular film material 3, and the shaping member 20 is formed so as to have an outer size or dimension slightly smaller than the outer size or dimension of the film material 3 so as to be capable of being disposed inside the outer edges of the film material 3.

The shaping member 20 is formed form a cardboard (thickened paper) or like and has two flat surface forming portions 21 and 22 for shaping the flat surface portions 4 and 5, and two side surface forming portions 23 and 24 for shaping the side surface portions 6, 6. These flat and side surface forming portions 21, 22 and 23, 24 are arranged side by side alternately as shown in FIG. 2 and boundary portions of these respective portions are connected through foldable line portions 25. These flat surface forming portions 21 and 22 have rectangular outer shapes, respectively, and their lateral widths are longer than vertical dimensions thereof so as to provide longitudinally rectangular shapes. While, the side surface forming portions 23 and 24 are formed so as to provide slightly longitudinally longer rectangular shape.

The shaping member 20 is further provided, at its flat surface forming portions 21 and 22, with bottom surface forming portions 26 so as to extend downward from the lower ends thereof. The bottom surface forming portions 26 each has a rectangular shape having a width slightly shorter than the width of the flat surface forming portions 21 and 22.

As shown in FIG. 2, the shaping member 20 is disposed on one surface side of the film material 3 such that the lateral direction thereof is coincident with the long axis direction of the film member 3. A portion 31 of the film material 3, having a predetermined range, extends off from the upper ends of the flat surface forming portions 21, 22 and the side surface forming portions 23, 24, and a portion 33 of the film material 3, having a predetermined range, also extends off from the lower ends of the flat surface forming portion 21, 22 and the side surface forming portions 23, 24.

Moreover, overlap sealing width portions 32 and 34, each having a predetermined width, are formed along the respective end edges of the upper and lower ends of the film material 3. Overlap sealing width portions 35 and 36 are also formed so as to extend off from both the side edges of the shaping member 20. The peripheral edge portion of the shaping member 20 is sealed to the film member 3.

The portions 31 and 33 having predetermined ranges of the film member 3 extending off from the upper and lower ends of the shaping member 20 are formed as upper surface portion 7 and bottom surface portion 8, respectively. Further, hereunder, the portion extending off from the upper end of the shaping member 20 is referred to as upper extending portion 31, and on the other hand, the portion extending off from the lower end of the shaping member 20 is referred to as lower extending portion 33.

Figure 3:
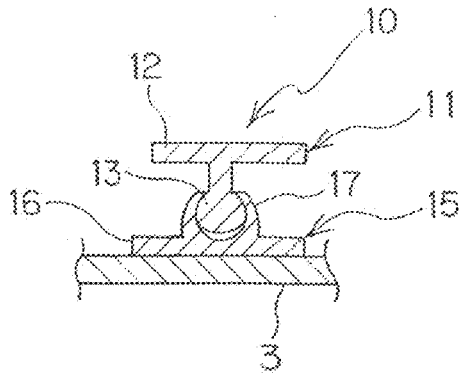
FIG. 3 is a cross sectional view of one example of a fastener attached to the bag body of the packaging bag of FIG. 1.

The fastener 10 is attached to the upper extending portion 31 of the film member 3 such that central portions 31*a*, 31*a* thereof corresponding to the side surface portions 6, 6 are connected together at slightly lower portion of the overlap sealing width portion 32 formed to the upper end thereof. This fastener 10 is composed of, as shown in FIG. 3, a male faster portion 11 and a female fastener portion 15, which are engageable with each other, and the fastener 10 is attached to the film member 3 in the engaged state.

The male fastener portion 11 is composed of a belt-shaped base portion 12 and a protruded rib or bar 13 protruding from one surface of the base portion 12 so as to extend at the central portion in its width direction. The protruded rib 13 has an end portion formed so as to be round in section. On the other hand, the female fastener portion 15 is composed of a base portion 16 and a groove portion 17 formed on one surface side in the central portion in the width direction thereof.

These male and female fastener portions 11 and 15 are engaged with or disengaged from each other by fitting the round portion of the protruded rib 13 into the groove portion 17 or removing the round portion of the protruded rib 13 from the groove portion 17. FIG. 3 shows the state in which the male and female fastener portions 11 and 15 are integrally engaged with each other by fitting the round portion of the protruded rib 13 into the groove portion 17 and the female fastener portion 15 is attached to the film material 3.

A tubular structure 50 is formed from the state shown in FIG. 2 in the following manner. That is, the shaping member 20 is bent at the right angle at folding line portions 25 formed to the boundaries between the flat surface forming portions 21, 22 and the side surface forming portions 23, 24, respectively, and the end edges of the flat surface forming portion 22 and the side surface forming portion 23, constituting both the side edges of the shaping member 20, are abutted against to each other. In this manner, the tubular structure 50 having the rectangular sectional shape is formed.

Figure 4:
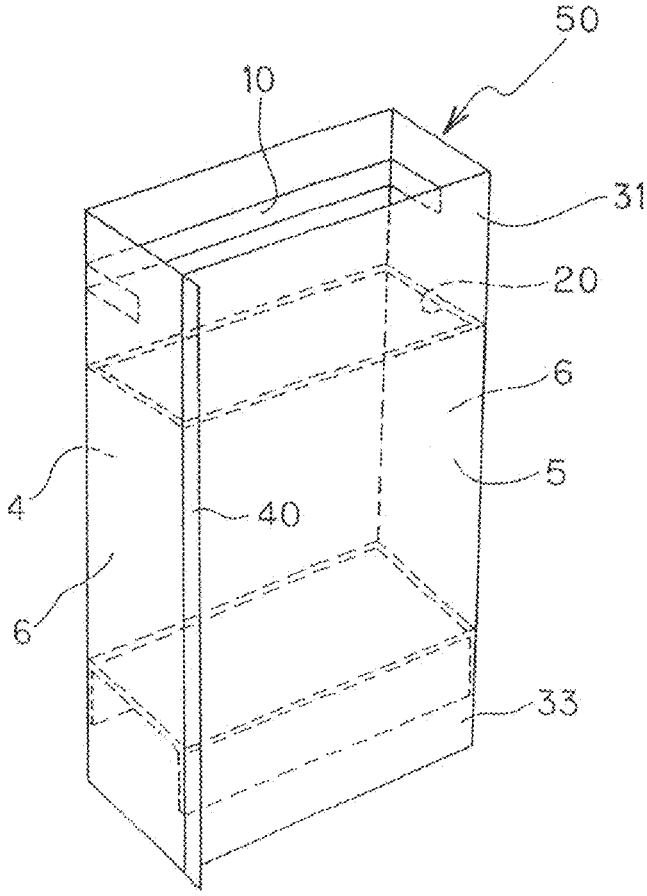
FIG. 4 is a perspective view showing a tubular structure formed from a film material by bending a shaping member from the state shown in FIG. 2.

Then, the overlap sealing width portions 35 and 36 are overlapped and sealed together. This state is shown in FIG. 4. The sealed portion constitutes a vertical seal portion 40. As can be seen from FIG. 4, the vertical seal portion 40 is formed along the boundary line between the back surface portion 5 of one of the flat surface portions 4 and 5 of the packaging bag 1 and one of the side surface portion 6.

Thereafter, the bottom surface portion 8 is formed in the following manner.

With also reference to FIG. 2, reference (base) points P1 are imaged on the inner edge of the sealing width portion 34 at portions corresponding to the side surface portions 6, 6 at the lower extending portion 33. This reference point P1 is a point positioned at the central portion in the width direction of the portion corresponding to the side surface portion 6. Side end points Q1 are also imaged on the boundary line between the side surface portions 6, 6 and the flat surface portions 4 and 5 on the inner edge of the sealing width portions 35 and 36 at the lower end positions of the side surface forming portions 23 and 24 in the lower extending portion 33. These points P1 and Q1 are connected respectively by oblique lines L1.

Figure 5:
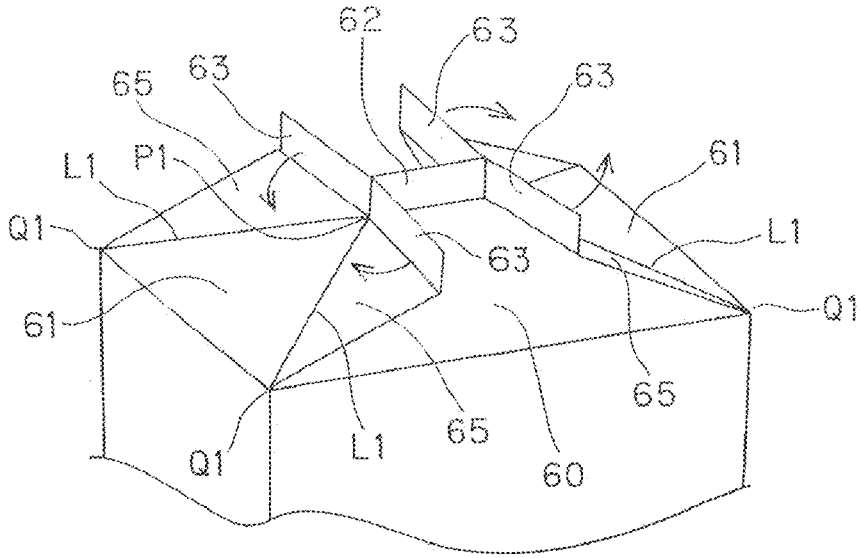
FIG. 5 is a perspective view showing a bottom portion of the tubular structure of the bag body during the manufacture thereof.

A flat surface folding portion 60 shown in FIG. 5 is formed from the tubular structure 50 shown in FIG. 4 such that the portions corresponding to the flat surface portions 4 ad 5 are folded ad bent toward the center side with the lower ends of the flat surface forming portions 21 and 22 being reference lines. Furthermore, the portions corresponding to the side surface portions 6 are folded and bent toward the center side with the lower ends of the side surface forming portions 23 and 24 being reference lines. Concerning the portions corresponding to the side surface portions, an isosceles triangular portion surrounded with the reference lines corresponding to the lower ends of the side surface forming portions 23 and 24 and the oblique line L1 is formed as triangular folded (folding) portion 61, which will be explained hereunder. Further, concerning the lower extending portion 33, the overlap sealing width portions 34 of the lower ends thereof are bonded together.

At this time, with each of the portions 62 between the two reference points P1, as shown in FIG. 5, the inner surfaces thereof are bonded to the portions corresponding to the flat surface portions 4 and 5. On the other hand, with each of the portion 63 positioned on both sides of the portions 62 between the two reference points P1 and on the side of the respective reference points P1, the inner surfaces of the portions corresponding to the flat surface portions 4 and 5, and the inner surfaces of the portions corresponding to the side surface portions 6 are bonded together. The bonding of the portions corresponding to the flat surface portions 4 and 5 and the portions corresponding to the side surface portions 6, 6 are performed such that the portion corresponding to the front flat surface portion 4 and the portion corresponding to the back flat surface portion 5, in their front and rear areas, are bonded with the position 31*a* corresponding to the central portion of each side surface portion being the boundary. Thus, the overlap sealing width portion 34 provides substantially "H" shape as shown in FIG. 5.

Thereafter, the oblique line L1 formed to the portion corresponding to the side surface portion 6 is folded inward of the tubular structure so as to provide convex shape, and then, the triangular portion 65 positioned outside of the oblique line L1 is folded back toward the center of the tubular structure 50 as shown with arrows in FIG. 5. Then, the triangular folded portion 61 having the isosceles triangular shape formed inside the oblique line L1 is covered from its outer side by the triangular portion 65. Furthermore, in the overlap sealing width portion 63 at the triangular portion, longitudinally opposing portions are further sealed. The thus formed "H" shaped sealed overlap portions 62 and 63 constitute the lower end seal portion 41 which can tightly seal the lower portion of the package bag 1.

Figure 6:
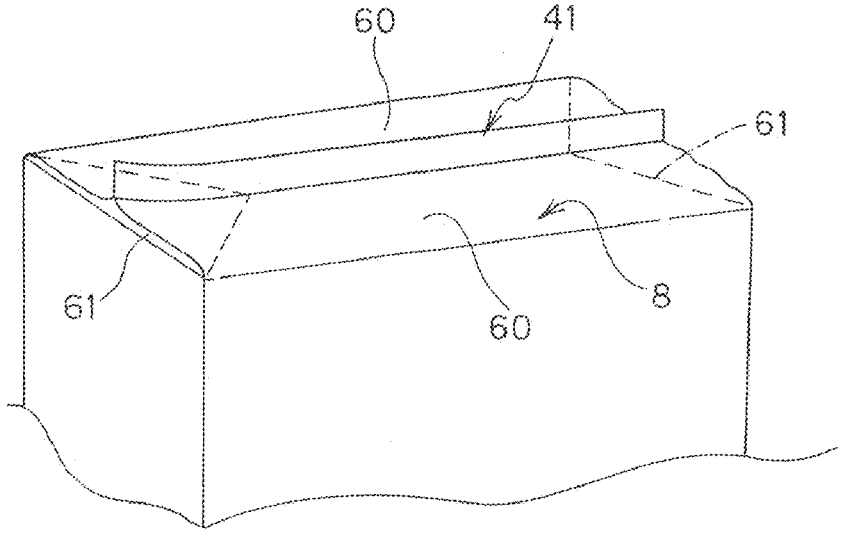
FIG. 6 is also a perspective view showing a bottom portion of the tubular structure during the manufacture thereof.

Thereafter, the lower end seal portion 41 is bent to the back surface side of the packaging bag 1 and then bonded to the film material 3. Accordingly, by folding and then sealing the lower extending portion 33, the flat bottom portion 8 can be provided as shown in FIG. 6.

Figure 7:
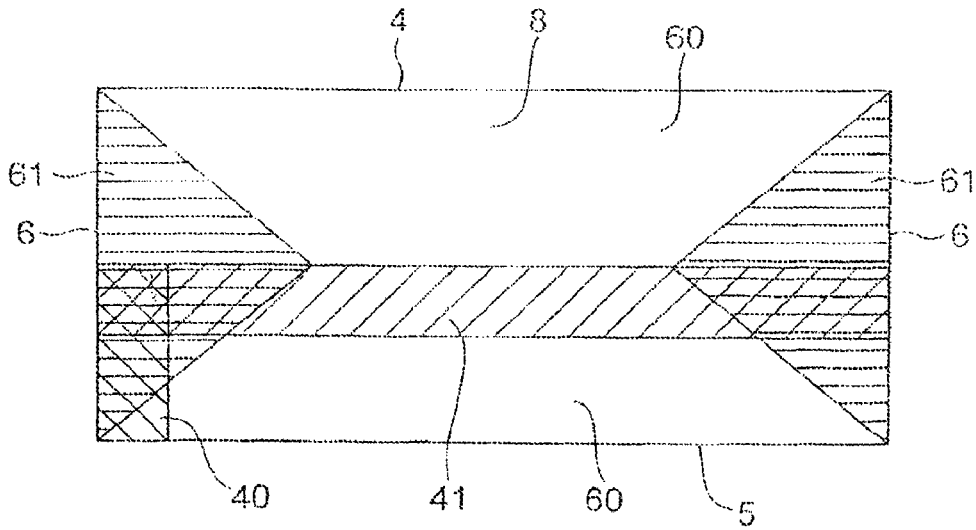
FIG. 7 is an explanatory view showing a state in which the film material is overlapped at the bottom portion after being formed.

FIG. 7 shows an overlapped state of the film material 3 at the bottom surface portion 8 of the packaging bag 1 with oblique lines. Further, for the sake of comparison, a conventional example of such overlapped state of a conventional packaging bag provided with a shaping member 20 is shown in FIG. 8.

As shown in FIG. 7, in the bottom surface portion 8 of the packaging bag 1 of the present embodiment, the film material 3 is provided such that the flat surface folding (folded) portion 60 and the triangular folded portion 61 are overlapped at portions near both side portions. In addition, at the central portion in the longitudinal direction, the lower end seal portion 41 is disposed in form of belt extending laterally, and this lower end seal portion 41 and the flat surface folding portion 60 are overlapped.

Moreover, with the one side surface portion positioned left side in FIG. 7, the vertical seal portion 40 is overlapped from the central portion in the longitudinal direction toward the back surface portion 5. In addition, in the packaging bag 1 of this embodiment, a bottom surface forming portion 26 is provided for the shaping member 20. On the contrary, with the bottom surface portion 8*a* of the conventional packaging bag, as shown in FIG. 8, only the triangular folded portion 61 is overlapped with the flat surface folding portion 60*a*. Moreover, any bottom surface forming portion is not provided for the shaping member 20 as in the present embodiment.

Figure 8:
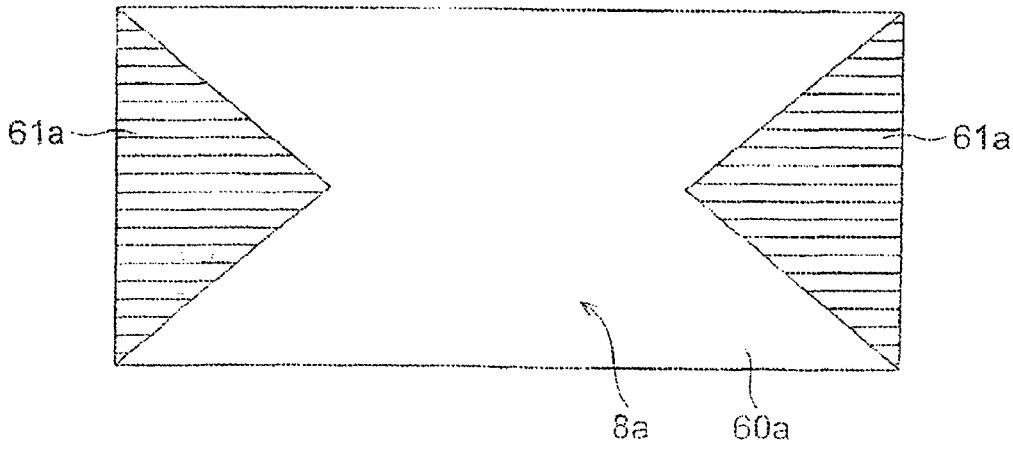
FIG. 8 Prior Art
FIG. 8 is an explanatory view showing a state in which the film material is overlapped at the bottom portion of a packaging bag of a conventional structure.

As mentioned above, in the bottom surface portion 8 of the packaging bag 1 of this embodiment, many overlapped portions of the film material are formed in comparison with the packaging bag of the conventional structure of FIG. 8, thus increasing the strength and rigidity thereof. In addition, since the shaping member 20 is provided with the bottom surface forming portion 26, the strength of the bottom surface portion 8 can be improved and the bottom surface portion of the packaging bag can be protected safely.

Further, the extending portion 31 is formed to the upper portion of the tubular member 50 as an upper surface portion 7 of the packaging bag 1.

Referring back to FIG. 2, the reference points P2 are imaged on positions corresponding to the lower end of the fastener mounting portion at the portions corresponding to the side surface portions 6, 6 on the upper extending portion 31. The reference point P2 is positioned on the central portion in the width direction of the upper extending portion 31 corresponding to the side surface portion 6. Next, side end points Q2 are imaged on the boundary line between the side surface portions 6 and the flat surface portions 4, 5 on the inner edges of sealing width portions 35, 36 at the upper end portions of the side surface forming portions 23, 24 of the upper extending portion 31. These reference points P2 and the side end points Q2 are connected as oblique lines L2.

Figure 9:
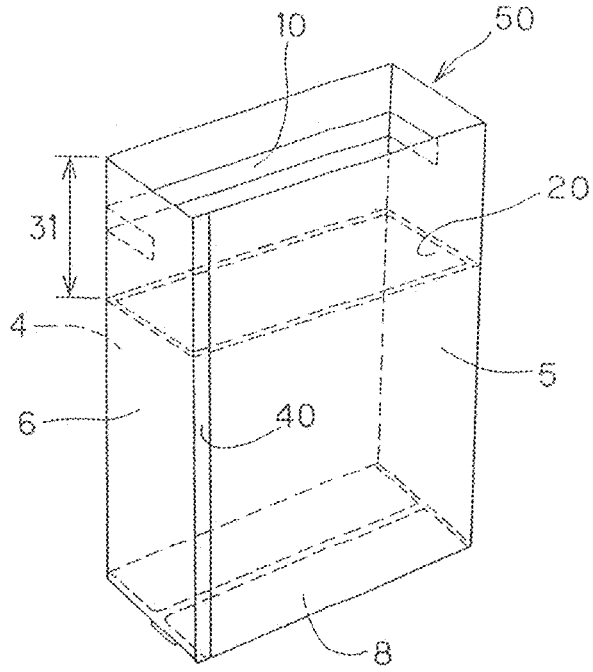
FIG. 9 is a perspective view of a tubular structure with a completed bottom portion.

Then, some portions of the upper extending portion 31, in a non-formed state as shown in FIG. 9, corresponding to the flat surface portions 4, 5 are folded and bent toward the center side with the upper ends of the flat surface forming portions 21, 22 being reference lines to thereby form flat surface folded portion 70.

Figure 10:
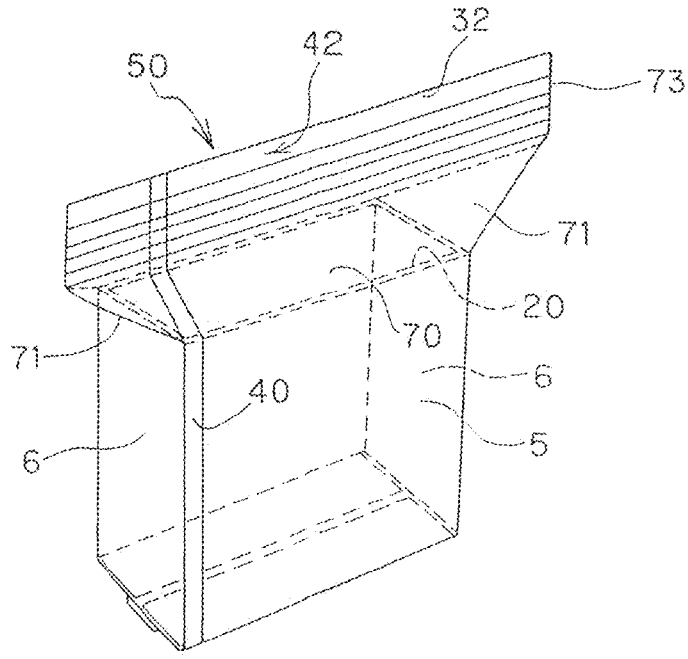
FIG. 10 is a perspective view of the tubular structure showing a formation process of an upper portion thereof.

In this folding operation, a portion upper than the reference point P2 is folded outward so as to provide a protruded shape with respect to the center of the position corresponding to the side surface portion 6, thus forming an overlapped portion 73 to the portion on the upper side of the reference point P2. In this operation, portions corresponding to the side surface portions 6 are folded outward with the upper ends of the side surface forming portions 23, 24 being the reference lines, the oblique lines L2 are folded outward so as to provide the protruded shape, and the isosceles triangular portion is formed on the inside of the oblique lines L2 as a triangular extending portion 71. An overlapped portion 73 on the upper side over the reference point P2 is sealed. FIG. 10 shows the state of the tubular member 50 after the overlapped portion 73 on the upper side of the reference point P2 has been sealed.

Further, in the state shown in FIG. 10, the overlap sealing width portion 32 forming the upper end of the overlapped portion 73 is tightly sealed as the upper seal portion 42 and seals the upper portion of the packaging bag 1. Further, at the lower portion of the upper seal portion 42, the film material 3 is not sealed and separated. At the fastener attaching portion, the base portion 12 of the male fastener portion 11 is sealed to the inner surface of the back surface portion 5.

Figure 11:
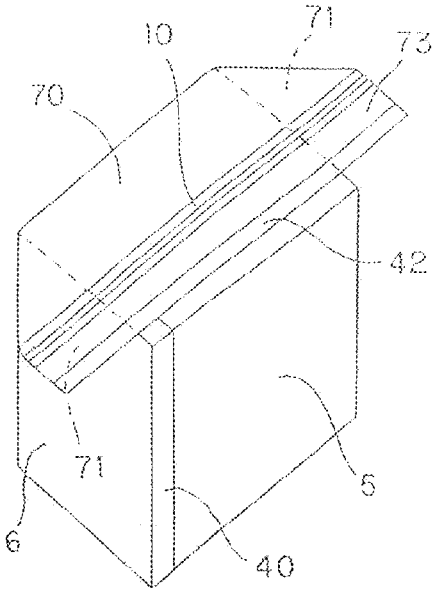
FIG. 11 is also a perspective view of the tubular structure showing a formation process of an upper portion thereof.

Thereafter, as shown in FIG. 11, the overlapped portion 73 is folded toward the back surface side of the packaging bag 1 in a state that the triangular extending portions 71 are extended outside the packaging bag 1. The overlapped portion 73 and the triangular extending portion 71 extending outward of the side surfaces 6 of the packaging bag 1 are bent and folded downward of the packaging bag 1 at the upper end portions of the side surface forming portions 23, 24, and then bonded to the outer surfaces of the corresponding side surface portions 6, thereby forming and completing the packaging bag 1 having hexahedron shape shown in FIG. 1.

Further, although in the packaging bag 1 of the structure mentioned above, the shaping member 20 provided with the bottom surface forming portion 26 was described, the packaging bag 1 may be formed without such bottom surface forming portion 26 of the shaping member 20.

Figure 12:
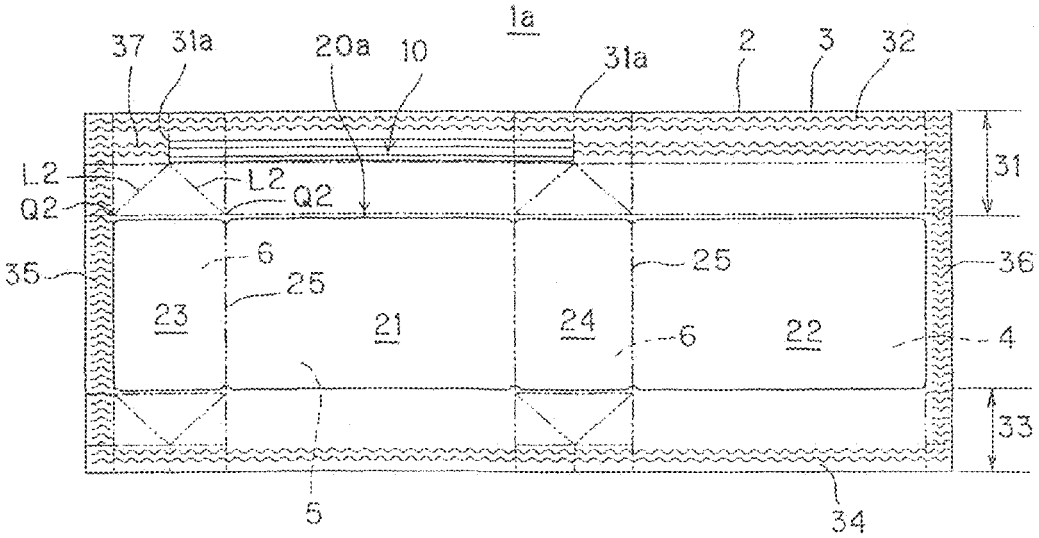
FIG. 12 is a developed view showing a packaging bag according to another embodiment of the present invention.

FIG. 12 is a developed view of a packaging bag formed by using a shaping member 20*a* provided with no bottom surface forming portion.

In a packaging bag 1*a* shown in FIG. 12, the shaping member 20*a* is not provided with a bottom surface forming portion, and a shaping member having a rectangular outer shape is adopted as the shaping member 20*a*.

The packaging bag 1*a* of this example has a bag body 2 formed from the film material 3, and the shaping member 20*a* is formed so as to have an outer shape smaller than the outer edge of the film material 3 so that the shaping member 20*a* can be accommodated inside the outer edge of the film material 3.

The shaping member 20*a* is composed of two flat surface forming portions 21, 22 forming the flat surface portions 4, 5 and two side surface forming portions 23, 23 forming the side surfaces 6, 6. These flat surface forming portions 21, 22 and the side surface forming portions 23, 24 are alternately arranged in the developed state, and folding (folded) lines 25 for folding the shaping member 20*a* are formed to boundary lines between the respective these surface forming portions.

Moreover, a portion of the film material 3 extending from the upper end of the shaping member 20*a* forms the upper extending portion 31, and a portion of the film material 3 extending from the lower end of the shaping member 20*a* forms the lower extending portion 33. The film material 3 are formed, at its outer peripheral edge portion, with overlap sealing width portions 32, 34, 35 and 36, and a fastener attaching portion 37 to which the fastener 10 is attached is formed to a portion slightly downward of the overlap sealing width portion 32.

On the lower extending portion 33, there is formed an oblique line L1 connecting the reference point P1 and the side end points Q1, in which the reference point P1 is a point imaged on the inner edge of the overlap sealing width portion 34 and the side end points Q1 are points imaged on the boundary line, on the inner edges of the overlap sealing width portions 35, 36, between the flat surface portions 4, 5 and the side surface portions 6, 6.

On the upper extending portion 31, there is also formed an oblique line L2 connecting the reference point P2 and the side end points Q2, in which the reference point P2 is a point imaged on the portion corresponding to the side surface portion at the position corresponding to the lower end of the fastener attaching position and the side end points Q2 are points imaged on the boundary line, on the inner edges of the overlap sealing width portions 35, 36, between the flat surface portions 4, 5 and the side surface portions 6, 6.

The material developed as shown in FIG. 12 is also formed into the packaging bag having a hexahedron shape through the steps mentioned above in connection with the former embodiment.

Further, in a case when it is required to manufacture a lot of such packaging bags, a belt-shaped film material is utilized, which is delivered to which fasteners and shaping members are respectively arranged.

Figure 13:
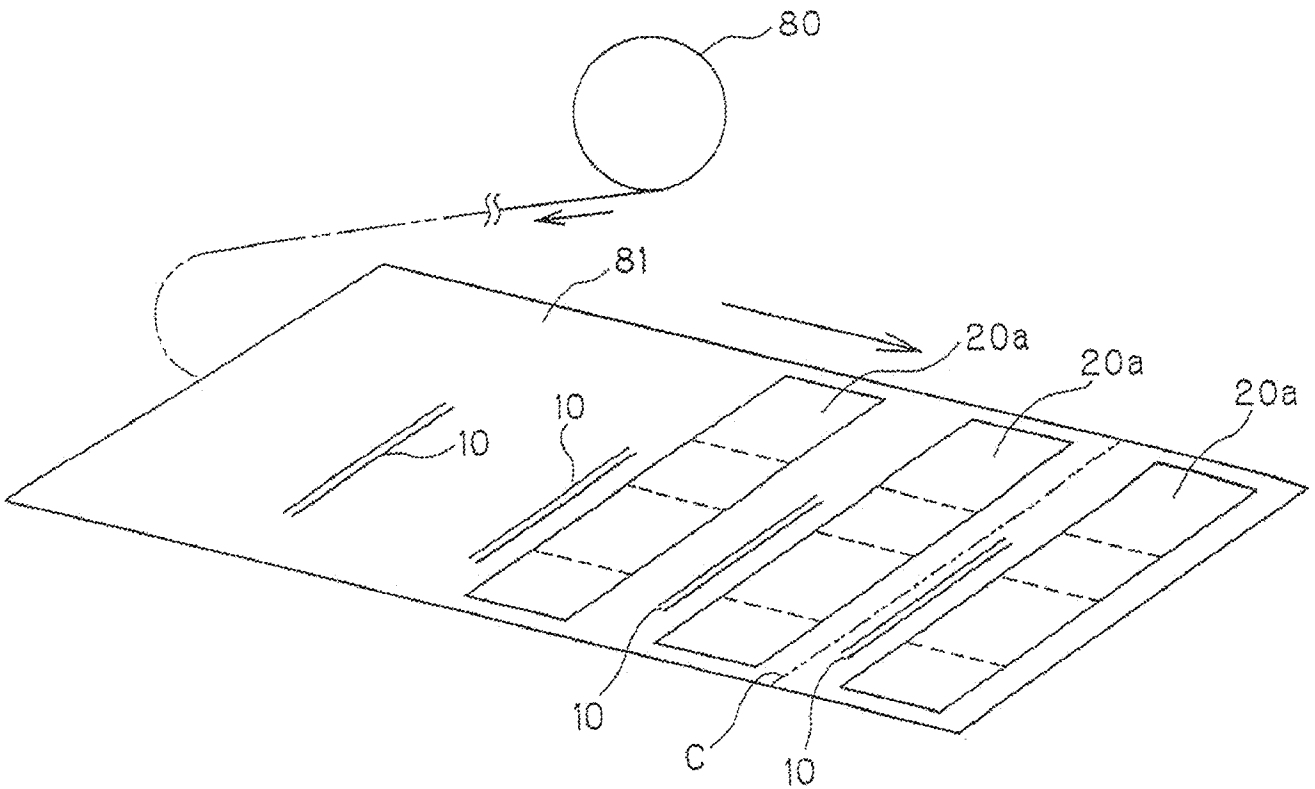
FIG. 13 is a view showing one example of a process of attaching a fastener and a shaping member to a film material at the time of mass production of the packaging bags.

FIG. 13 represents this film material feeding and delivering step.

With reference to FIG. 13, a belt-shaped film material 81 is fed from a film material roll 80, and the fasteners 10 are attached thereto with predetermined interval in the longitudinal direction thereof. Each of the fasteners 10 is composed of the male fastener member 11 and the female fastener member 15, as shown in FIG. 3, which are engaged with each other, and is attached to the film material 81 so that the axial direction of the fastener 10 accords with the width direction of the film material 81.

Then, the shaping members 20*a* are subsequently arranged on the upstream side of the fasteners 10, respectively, on the film material 81 in the delivering direction thereof so that the shaping member 20*a* is separated from the fastener 10 with a predetermined distance and the longitudinal direction of the shaping member 81 accords with the with direction of the film material 10. The shaping member 20*a* is bonded to the film material 81 at its peripheral portions.

Thereafter, the film material 81 is cut sequentially at cut lines C positioned on the upstream side of each of the fasteners 10 as shown with two-dot-chain lines. Each cut film material corresponds to that shown in FIG. 12 as a developed view of the packaging bag 1*a*. From this state, the packaging bags can be manufactured one by one through the steps mentioned hereinbefore.

Further, in the example of FIG. 13, the shaping member 20*a* is not provided with a bottom surface forming portion, but if the shaping member 20*a* provided with the bottom surface forming portion is utilized, the packaging bag having the structure of the developed view of FIG. 2 will be manufactured.

Furthermore, in the above embodiment, the fastener tape is utilized as fasteners 10, but injection process may be also adapted for fastener forming process.

Still furthermore, it is to be noted that the present invention is not limited to the described embodiment and many other changes and modifications may be made without departing from the scopes of the appended claims.

What is claimed is:

1. A method of manufacturing a packaging bag, comprising the steps of:

providing a sheet (3) of rectangular film material from which a bag body (2) is to be formed;

providing a shaping member (20) for keeping a shape of the bag body, the shaping member, when folded, having a hexahedron shape with a pair of opposing flat surface forming portions (21, 22), a pair of opposing side surface forming portions (23, 24), and a bottom surface forming portion (26); and positioning the shaping member (20) on the sheet of film material (3) and folding the sheet of film material on the shaping member to form the bag body (2), wherein the folding step includes, bonding inner surfaces of opposing side edges (35, 36) of the film material with a constant bonding width so as to form a tubular member (50) with an upper extending portion (31) at an upper end of the shaping member and a lower extending portion (33) at a lower end of the shaping member, folding the upper extending portion to form an upper surface portion (7) of the bag body, folding the lower extending portion to form a bottom surface portion (8) of the bag body, and preparing and attaching a re-sealable fastener to the upper surface portion (7), wherein the step of folding the lower extending portion includes (a) sealing a lower end seal portion (62) having a constant width by sealing a first portion, between two reference points (P1, P1), of opposite flat surface folding portions (60) of the lower extending portion (33), (b) folding a portion of the lower extending portion to form two triangular folded portions (61) that are each defined by a respective reference line (Q1-Q1) at the lower end of a respective one of the side surface forming portions (23, 24) of the shaping member and two oblique lines (L1, L1) that extend from ends of the respective reference line to a respective one of the two reference points, (c) sealing overlap sealing width portions (63) having the constant width by sealing remaining portions of opposing sides of the lower extending portion outside the two reference points (P1, P1) thereby creating two further triangular portions (65) that each has a side defined by a respective one of the two oblique lines, the lower end seal portion (62) and the sealing overlap sealing width portions (63) having an H-shape when viewed from overhead, the lower end seal portion being a crossbar of the H-shape and the sealing overlap sealing width portions being legs of the H-shape, (d) folding the two further triangular portions (65) directly onto a respective one of the two triangular folded portions (61) whereby the lower end seal portion (62) and the sealing overlap sealing width portions (63) form a linear lower end seal portion (41), and (e) folding over and sealing the linear lower end seal portion (41) to form the bottom surface portion (8) that is flat, and wherein the bottom surface forming portion (26) of the shaping member has a size corresponding to the bottom surface portion (8) and is overlapped by the two triangular folded portions (61), the further triangular portions (65), the folded over linear lower end seal portion (41), and the flat surface folding portions (60).

2. The method of manufacturing a packaging bag according to claim 1, wherein the flat surface forming portions and the side surface forming portions are folded along folding lines disposed in parallel with each other, with both ends forming end edges of the flat surface forming portions of the shaping member and end edges of the side surface forming portions being abutted against each other.

3. The method of manufacturing a packaging bag according to claim 1, wherein the bonded inner surfaces of opposing side edges (35, 36) are disposed on a back surface side of the packaging bag so as to be along one side end edge of the back side surface.

* * * * *